United States Patent [19]

Glaesel

[11] 4,015,890

[45] Apr. 5, 1977

[54] IDENTIFICATION MEMBER FOR ELECTRICAL TERMINALS

[75] Inventor: Gottfried Glaesel, Minusio, Switzerland

[73] Assignee: Heco Electric GmbH, Glarus, Switzerland

[22] Filed: May 7, 1976

[21] Appl. No.: 684,346

[52] U.S. Cl. ..... 339/113 B; 339/22 B

[51] Int. Cl.² ..... H01R 3/00

[58] Field of Search ..... 339/113 B, 113 R, 113 L, 339/22 B, 22 R, 75 A, 76, 77

[56] References Cited

UNITED STATES PATENTS

| | | | |
|---|---|---|---|
| 3,201,747 | 8/1965 | Blanchet | 339/113 B |
| 3,727,171 | 4/1973 | Coles et al. | 339/22 B |

FOREIGN PATENTS OR APPLICATIONS

| | | | |
|---|---|---|---|
| 1,952,088 | 4/1971 | Germany | 339/113 B |
| 1,171,047 | 5/1964 | Germany | 339/113 B |
| 891,095 | 3/1962 | United Kingdom | 339/113 B |

*Primary Examiner*—Roy Lake
*Assistant Examiner*—DeWalden W. Jones
*Attorney, Agent, or Firm*—Pollock, Vande Sande & Priddy

[57] ABSTRACT

An identification member for attachment to an uninsulated electrical terminal comprising a metal sleeve and a clamping screw consists of two plates of insulating material secured face to face by mating projections and recesses in the plates, each plate having a pair of legs with detent teeth for engaging the ends of the sleeves, and a recess to receive an identifying plate or tag, the mating faces of the plates containing matching recesses forming a bore for the screw.

11 Claims, 3 Drawing Figures

IDENTIFICATION MEMBER FOR ELECTRICAL TERMINALS

This invention relates to an identification member adapted to be attached to an uninsulated electrical terminal comprising a metal sleeve and a clamping screw located in a wall of the sleeve for clamping a conductor inserted into the sleeve.

Uninsulated screw-clamping terminal sleeves are commonly used in electrical installations for making earth or neutral connections to bus bars. To enable individual terminals to be readily identified, identification members are sometimes clipped onto the sleeves. However, the integral construction used means that it is not possible to incorporate color coding for identifying the terminal as an earth connection, using the common green/yellow coding for earth connections. Also, in the case of some forms of identification member, the position of the identification-carrying side of the member depends on the diameter of the conductor. Furthermore, existing identification members cannot readily be attached to previously installed terminals.

The object of the present invention is to provide an identification member capable of being attached to an uninsulated electrical terminal, which member is simple to manufacture and use and avoids the above-mentioned disadvantages of existing identification members, and in particular can readily be manufactured in two colors and can be clipped onto an already installed terminal.

The present invention resides in an identification member for attachment to an uninsulated electrical terminal comprising a metal sleeve and a clamping screw located in a wall thereof, which identification member consists of two plates of insulating material provided with means for securing the plates together face to face, each of the two mating faces containing a recess extending thereacross to accommodate the clamping screw, at least one plate having a pair of generally parallel laterally spaced legs at opposite sides thereof and retaining detent members on the legs for engaging in the ends of a said sleeve of a terminal to retain the identification member thereon, at least one recess being provided in that side of each plate that faces away from the legs, adapted to receive an identifying plate or tag.

Preferably, each said plate is provided with a said pair of legs, and in general the two plates will be of substantially identical shape and dimensions.

The two plates can readily be made of material of different colors or provided with markings of different colors.

Figure 1:
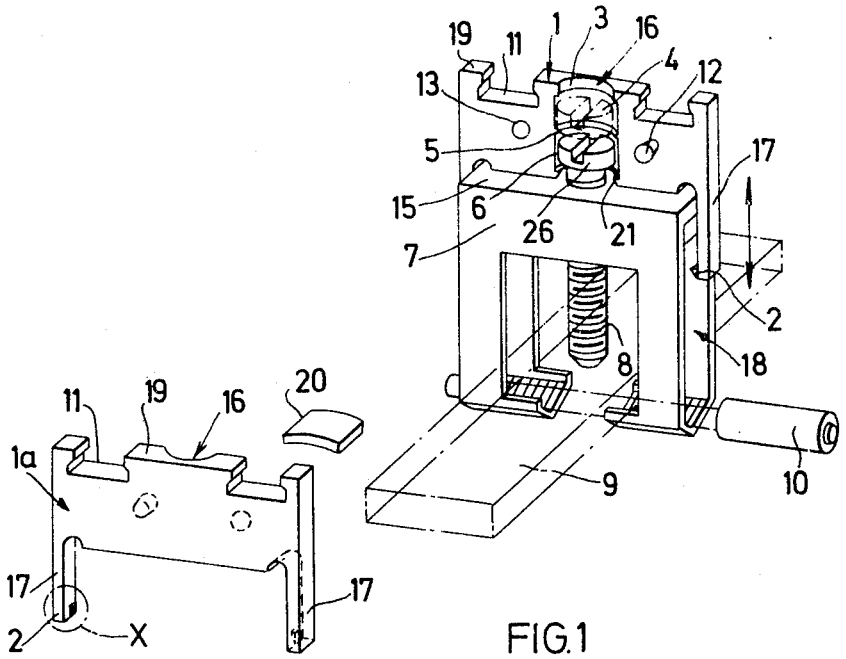
Figure 2:
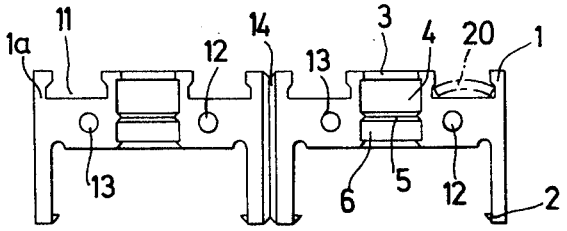
Figure 3:
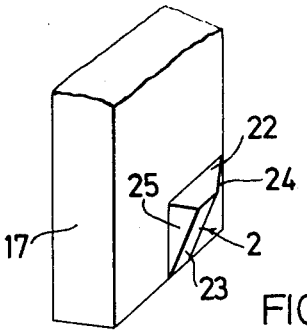

Embodiments of the invention are shown in the accompanying drawings, in which:

FIG. 1 show, in perspective, an uninsulated electrical terminal and the two plates of an identification member embodying the invention, FIG. 2 shows an identification member of integral construction, and FIG. 3 shows the detail X of FIG. 1, on a larger scale.

FIG. 1 shows an earth bus bar 9 over which is fitted an uninsulated earthing terminal comprising a metal sleeve 7 and a clamping screw 8 threaded in the wall 15 of the sleeve, so that by means of this terminal the conductor 10 can be clamped to the bus bar.

To enable the terminal to be identified, an identification member is provided which consists of identical plates 1, 1*a* of insulting plastic material. Each plate is provided with a flared or headed pin 12 and a recess 13, so that by interengagement of the pins 12 and recesses 13 of the plates, the latter can be secured together face to face.

The mating faces of the plates contain respective recesses 16 to accommodate the clamping screw 8. These recesses together define a bore.

Each plate has at opposite sides parallel laterally spaced legs 17 the spacing between which is substantially equal to the length of the sleeve 7 (this being a standard dimension). Each leg has at or adjacent to its free end an inwardly projecting detent hook 2 so that, by virtue of the slight resilience of the legs, the plates can be clipped over the sleeve 7, the hooks 2 engaging in the open ends 18 of the sleeve to retain the plates thereon. The sides 19 of the plates that face away from the legs contain undercut recesses 11 to receive identification plates or tags 20 which may carry numbers, letters or other symbols.

Each of the recesses 16 contains a bead 3 at the end which in use is remote from the terminal, and another bead 21 at the end adjacent to the terminal. In addition an intermediate bead 5 divides the bore composed of the recesses into upper and lower regions 4 and 6 respectively. The bead 3 is of sufficiently small diameter to prevent passage of the head of the clamping screw. It can also be used as a guide for a screwdriver to operate the clamping screw.

The bead 5 is also of smaller diameter than the clamping screw head but has sloping surfaces so that, under pressure, the screw head can move past it. The bead 21 has a sloping undersurface and a flat upper surface so that the screw head can move past it into the bore but not out of the bore.

As shown in FIG. 3, each of the hooks 2 has an upper surface 22 perpendicular to the longitudinal direction of the leg 17, an oblique lower face 23, and an oblique side face 24 on that side of the hook which, in use, is closest to the other of the plates. The other side face 25 of the hook is perpendicular to the surface of the leg and parallel to the longitudinal direction of the latter.

The plates 1, 1*a* can be assembled together and clipped onto the sleeve 7 in various ways. For example, the two plates can be fastened together by means of the pins 12 mating with recesses 13, and the resulting assembled identification member can then be clipped onto the sleeve 7 by movement parallel to the axis of the clamping screw so that the hooks 2 clip over the ends of the wall 15 of the sleeve and the bead 21 is forced past the head of the clamping screw. The oblique faces 23 of the hooks facilitate assembly in this way. Alternatively, the plates can be clipped separately onto the sleeve either by movement parallel to the clamping screw axis (by virtue of the sloping faces 23 of the hooks) or by movement perpendicular to the clamping screw axis (by virtue of the sloping side faces 24 of the hooks), and the plates thereafter fastened together by means of the pins 12 and recesses 13, enclosing the head of the clamping screw between them.

Normally, when the clamping screw has been tightened, its head is in the lower region 6 of the bore, as shown in FIG. 1. The plates 1, 1*a* are held captive by the bead 21. If the screw is unscrewed, its head will engage the bead 5 and lift the plates, until the hooks 2 engage the underside of the wall 15 of the sleeve 7. On further unscrewing, the screw head will ride over the bead 5 and enter the upper region 4 of the bore. In this condition the screw is held captive by the outermost bead 3, in a position in which the terminal is loose relative to the bus bar 9. When the terminal is to be fastened in place, light pressure with a screwdriver will push the screw head back into the lower region 6 of the bore. In the clamped state, movement of the identification member comprising the plates 1, 1*a* is limited by the beads 5 and 21 and the head 26 of the clamping screw, so that the position of the identification member is substantially fixed in relation to the bus bar 9, regardless of the thickness of the conductor 10 and the position of the sleeve 7. The positions of the hooks 2 on the legs 17 are such as to permit limited relative movement of the identification member and clamping sleeve, so that the latter can accommodate conductors of different thicknesses.

The plates 1, 1*a* are preferably made of injection molded colored plastic insulating material, the color or colors of the plates being selected to provide color coding if desired. E.g., one plate may be green and the other yellow to indicate an earth terminal. Alternatively, coloring may be applied to the plates after molding e.g., by hot foil printing. In either case, the use of two individual plates to form the identification member facilitates the application of color coding.

FIG. 2 shows a modification in which the plates 1, 1*a* are integrally molded, being interconnected by a thin hinge portion 14.

Numerous modifications of the embodiment described are possible. For example, it is necessary to provide only one pair of legs, i.e., one plate could be manufactured without legs. Also, any of the beads 3, 5, 21 can be omitted from one of the plates, or other forms of constriction for engaging the clamping screw head can be provided.

I claim:

1. An identification member for attachment to an uninsulated electrical terminal comprising a metal sleeve and a clamping screw located in a wall thereof, which identification member consists of two plates of insulating material provided with means for securing the plates together face to face, each of the two mating faces containing a recess extending thereacross to accommodate the clamping screw, at least one plate having a pair of generally parallel laterally spaced legs at opposite sides thereof and retaining detent members on the legs for engaging in the ends of a said sleeve of a terminal to retain the identification member thereon, at least one recess being provided in that side of each plate that faces away from the legs, adapted to receive an identifying plate or tag.

2. An identification member as claimed in claim 1, in wich both plates are provided with said legs.

3. An identification member as claimed in claim 1, in which the securing means comprise at least one projection on one plate and at least one mating recess on the other plate.

4. An identification member as claimed in claim 3, including at least one said recess and at least one said projection on each plate.

5. An identification member a claimed in claim 1, in which at least one of the recesses for receiving the screw has at its outer end a constriction for keeping the screw captive.

6. An identification member as claimed in claim 1, in which at least one of the recesses for receiving the screw has a constriction at an intermediate position between its ends.

7. An identification member as claimed in claim 1, in which each detent member has at least one oblique face to permit clipping onto a said sleeve, and a retaining face facing towards the associated plate and substantially perpendicular to the longitudinal direction of the associated leg.

8. An identification member as claimed in claim 1, in which the two plates are hinged together.

9. An identification member as claimed in claim 8, in which the plates are made of plastic material and the hinge is integral with the plates.

10. An identification member as claimed in claim 1, in which the two plates are of different colors.

11. An identification member as claimed in claim 1, in which the two plates are of substantially identical shape and dimensions.

* * * * *

UNITED STATES PATENT AND TRADEMARK OFFICE

CERTIFICATE OF CORRECTION

PATENT NO. : 4,015,890

DATED : April 5, 1977

INVENTOR(S) : Gottfried Glaesel

It is certified that error appears in the above-identified patent and that said Letters Patent are hereby corrected as shown below:

[73], the Assignee is incorrectly identified as

Heco Electric GmbH

The correct identification is

Hego Electric GmbH

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*